US007481268B2

(12) United States Patent
Middleton et al.

(10) Patent No.: US 7,481,268 B2
(45) Date of Patent: Jan. 27, 2009

(54) COLLAR ASSEMBLY FOR PUMP THRUST ROD USED TO ACTIVATE MICROSWITCH VALVE ON CHEMICAL INJECTION PUMP

(75) Inventors: Glenn Harold Middleton, The Woodlands, TX (US); David Eugene Lemier, Houston, TX (US)

(73) Assignee: Dresser, Inc., Addison, TX (US)

( * ) Notice: Subject to any disclaimer, the term of this patent is extended or adjusted under 35 U.S.C. 154(b) by 250 days.

(21) Appl. No.: 11/560,951

(22) Filed: Nov. 17, 2006

(65) Prior Publication Data

US 2008/0115926 A1 May 22, 2008

(51) Int. Cl.
*E21B 43/22* (2006.01)
*B23P 15/00* (2006.01)
*F01L 31/02* (2006.01)

(52) U.S. Cl. ..... 166/75.12; 29/888.021; 91/346; 91/350; 166/90.1

(58) Field of Classification Search ..... 166/75.12, 166/90.1; 29/888.02, 888.021; 91/345, 346, 91/350, 352
See application file for complete search history.

(56) References Cited

U.S. PATENT DOCUMENTS 3,710,867 A * 1/1973 Bansbach ..... 166/244.1
4,411,313 A * 10/1983 Johnson et al. ..... 166/90.1
6,263,777 B1 7/2001 Lauder
6,343,653 B1 * 2/2002 Mason et al. ..... 166/312
6,745,838 B2 * 6/2004 Watson ..... 166/310
7,318,476 B2 * 1/2008 Ayres ..... 166/310

OTHER PUBLICATIONS

Chemical pump model 510B inhouse brochure Rev. 7, Plainsman Mfg. Inc., Plainsman Model 510B Chemical Pump Micro Valve Assembly, Apr. 20, 2004, 1 page.

* cited by examiner

*Primary Examiner*—Hoang Dang
(74) *Attorney, Agent, or Firm*—Fish & Richardson P.C.

(57) ABSTRACT

A collar assembly for inclusion with, or for a retrofit of, a chemical injection pump and method for manufacturing same. The collar assembly secures to a thrust rod of the chemical injection pump and may include a circular member having a central opening and a second opening offset from the central opening. The second opening receives a central portion of a continuous U-shaped member, wherein fingerlike extensions at opposite ends of the U-shaped member flank a toggle element of a switching mechanism. The fingerlike extensions actuate the toggle element so as to stroke the chemical injection pump. The collar assembly includes a reduced number of parts and a simplified manufacturing process.

21 Claims, 4 Drawing Sheets

150
60
180
160
170

150
60
180
160
170

150
60
180
160
170

150
60
180
160
170

150
60
180
160
170

COLLAR ASSEMBLY FOR PUMP THRUST ROD USED TO ACTIVATE MICROSWITCH VALVE ON CHEMICAL INJECTION PUMP

TECHNICAL FIELD

This invention relates to chemical injection pumps, and more particularly to an improved apparatus and production method for controlling a stroking action of the chemical injection pump.

BACKGROUND

Chemical injection pumps are used, for example, to inject a desired amount of a chemical into an oil and/or gas well or into surface production facilities for the oil and gas. Some chemical injection pumps control a stroke amount and stroke rate via articulation of a microswitch. The microswitch may be actuated, for example, using a collar secured to a portion of a thrust rod of the pump and including one or more projections extending therefrom. The thrust rod is attached to a pump actuator and articulates therewith. However, presently available collars are complex and expensive to manufacture. Thus, it is desirable to have a collar that is usable with different pump models in order to reduce costs, improve part availability, and simplify manufacturing.

Therefore, there is a need in the art to provide a collar adaptable to different model pumps, improved manufacturability, and having low manufacturing costs associated therewith.

SUMMARY

The present invention is directed to a collar assembly for inclusion with, or for a retrofit of, a chemical injection pump and method for manufacturing same. According to one embodiment, the collar assembly is secured to a thrust rod of the chemical injection pump and may include a circular or ring-shaped member having a central opening and a second opening offset from the central opening. The second opening receives a central portion of a continuous U-shaped member, wherein fingerlike extensions at opposite ends of the U-shaped member flank a toggle element of a switching mechanism. The fingerlike extensions actuate the toggle element so as to control a stroke length of the chemical injection pump. Further, the collar assembly has a narrow profile, permitting adjustability along a length of the thrust rod without causing interference with a portion of the pump. According to an embodiment of the present invention, the collar assembly does not require welding and includes a small number of parts. Consequently, the collar assembly of the present invention has lower associated manufacturing costs, a simplified manufacturing process, and reduced complexity, allowing for reduced maintenance and installation times.

The details of one or more embodiments of the invention are set forth in the accompanying drawings and the description below. Other features, objects, and advantages of the invention will be apparent from the description and drawings, and from the claims.

DESCRIPTION OF DRAWINGS

Other aspects of the present invention will be better understood from the following description, along with the accompanying drawings, wherein.

Like reference symbols in the various drawings indicate like elements.

DETAILED DESCRIPTION

Figure 1:
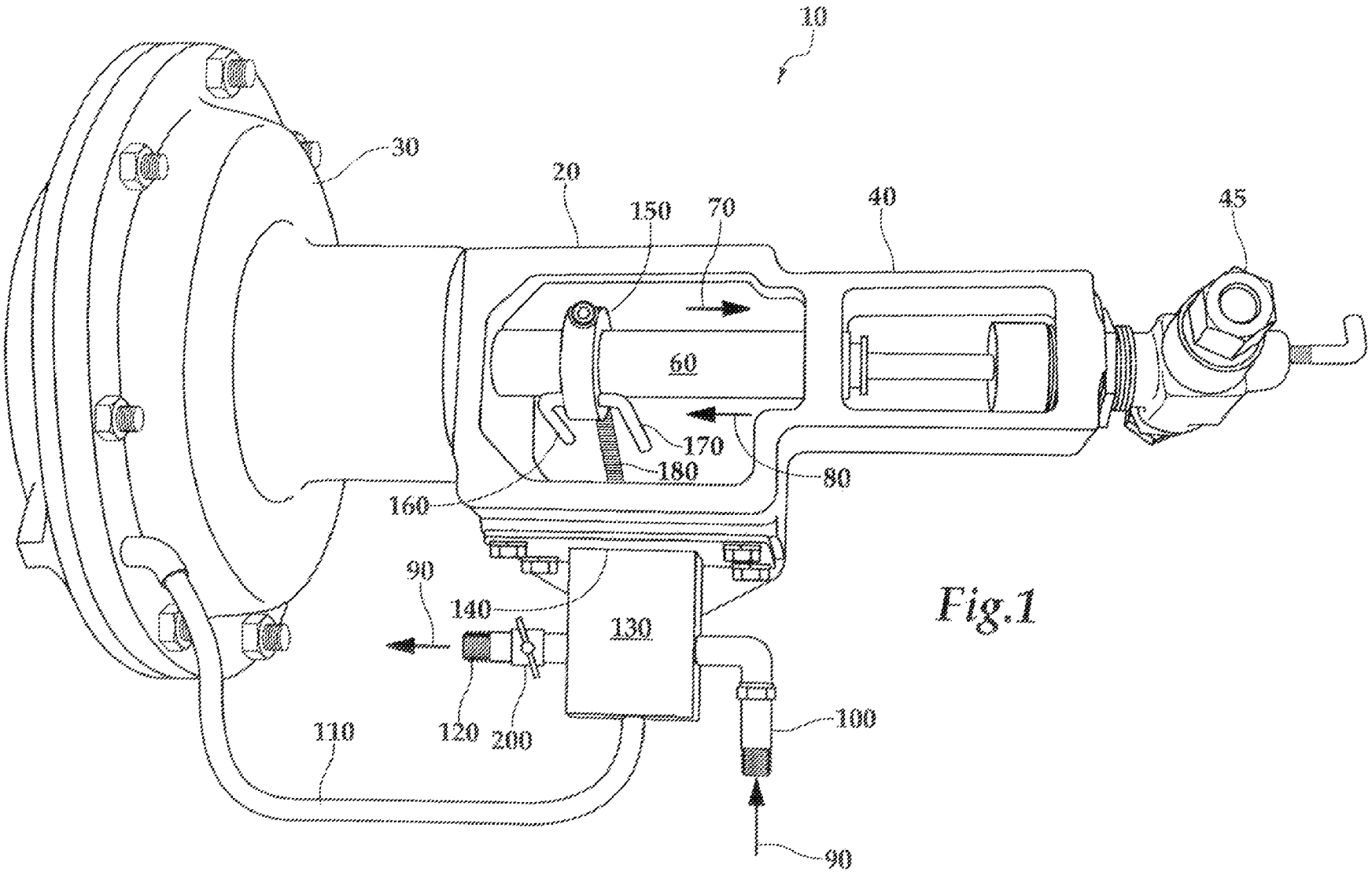
FIG. 1 is a perspective view of a chemical injection pump having a collar assembly according to an embodiment of the present invention.
Figure 2:
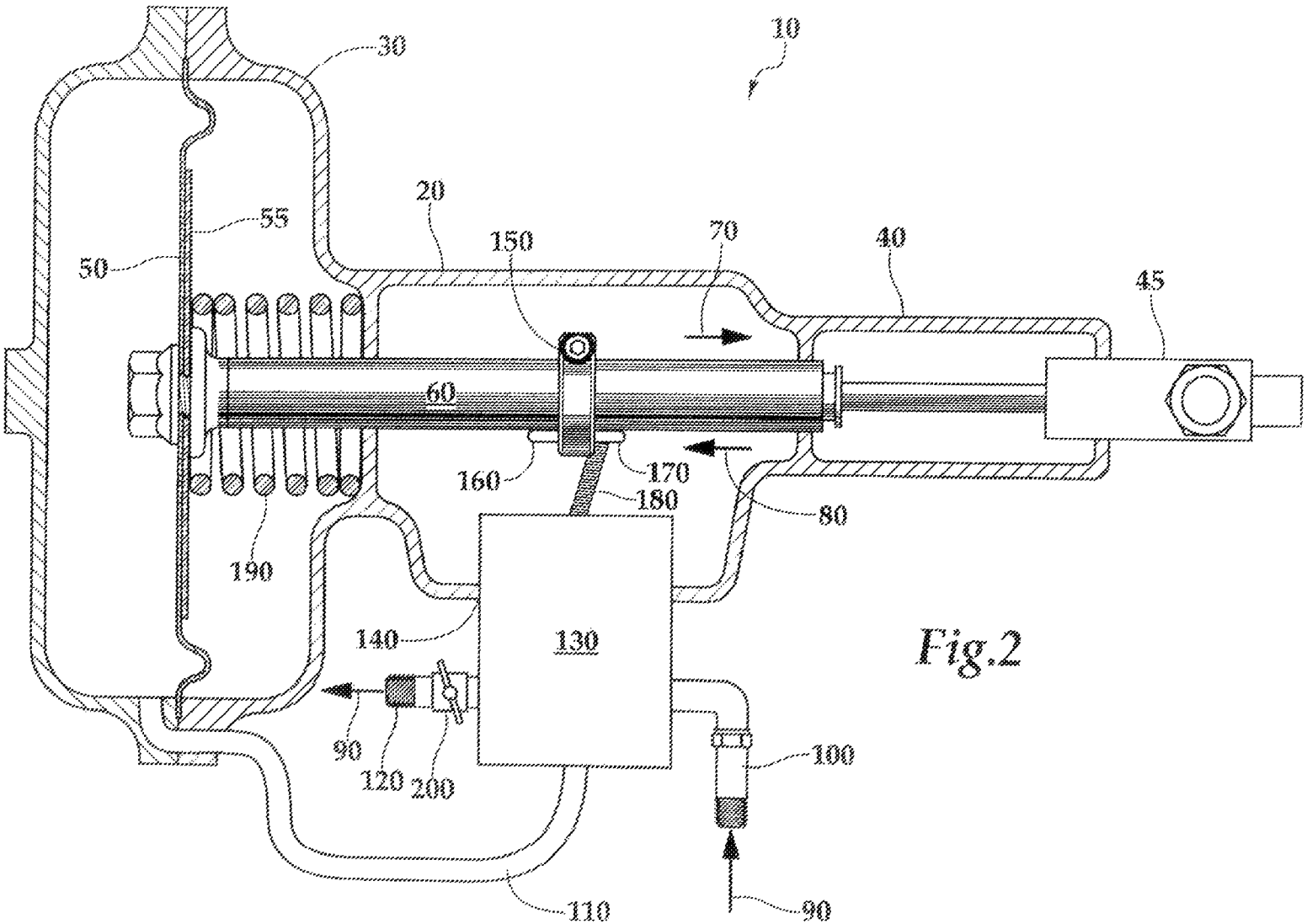
FIG. 2 is a partial cross-sectional view of a chemical injection pump of FIG. 1.

The present invention applies to a collar for a chemical injection pump, such as a pneumatic chemical injection pump. Chemical injection pumps may be used in industries such as oil and gas production, chemical processing, water treatment, and others. Referring to FIGS. 1 and 2, an exemplary chemical injection pump 10 includes a housing 20 having a pump actuator portion 30, an elongated portion 40, and an injection fitting 45. However, the collar assembly of the present invention is not limited to a pump having the configuration illustrated. Rather, the chemical injection pump 10 shown is merely presented as an example. The pump 10 also includes a biased diaphragm 50 contained in the pump actuator portion 30, and a thrust rod 60 coupled to the biased diaphragm 50. A diaphragm plate 55 may be disposed between the diaphragm 50 and a biasing element 190 (discussed below) to increase rigidity of a portion of the diaphragm 50. The pump 10 may be actuated by a pressurized gas 90, such that the thrust rod 60 strokes in a first direction, represented by arrow 70, when the pressurized gas is introduced into the pump actuator portion 30 and the thrust rod 60 moves in a second direction, represented by arrow 80, when the pressurized gas acting on the diaphragm 50 is vented. As the thrust rod 60 moves in the first direction, the chemical injection pump 10 injects an amount of a chemical (not shown) via the injection fitting 45.

The pressurized gas 90 is delivered to the pump actuator portion 30 via an inlet port 100 and a conduit 110. The pressurized gas 90 exits the pump 10 via the conduit 110 and an exhaust port 120. The inlet port 100, the exhaust port 120, and the conduit 110 are operably connected by a switching mechanism, such as a microswitch 130 known in the art. According to an embodiment of a chemical injection pump illustrated in FIG. 1, the microswitch 130 attaches to the housing 20 and extends through an opening 140 formed therein. The microswitch 130 is switched between a gas inlet condition and a gas exhaust condition via a toggle element 180 contacting a following member, such as a collar assembly 150, that follows the stroking movement of the thrust rod 60. For example, the collar assembly 150 may be attached to the thrust rod 60 and may include a pair of fingerlike extensions 160, 170. The fingerlike extensions 160 are disposed on adjacent sides of the toggle element 180 extending from the microswitch 130.

In operation, as the pressurized gas is applied through the inlet port 100 and conduit 110, pressure in the pump actuator portion 30 builds, eventually overcoming the bias of a biasing element 190, such as, for example only, a spring. Thereafter, the diaphragm 50 begins to deflect in the first direction causing the thrust rod 60 to correspondingly stroke in the first direction. Regarding FIGS. 1, 2, and 3A-E, as the thrust rod 60 continues to stroke, the first fingerlike extension 160 moves toward the microswitch toggle element 180. As the thrust rod 60 continues to stroke, the first fingerlike extension 160 engages the toggle element 180, causing the toggle element 180 to deflect. The toggle element 180 continues to be deflected until a biasing element (not shown) in the microswitch 130 causes the toggle element 180 to fully deflect in the first direction. Once the toggle element 180 fully deflects, the microswitch 130 severs communication between the inlet port 100 and the conduit 110 while enabling communication between the conduit 110 and the exhaust port 120. Consequently, the pressurized air in the pump actuator portion 30 is allowed to escape to the environment, for example, at a predetermined rate. The rate at which the pressurized gas is released may be adjusted by a valve 200 coupled to the exhaust port 120.

As the pressurized gas is released, the biasing element 190 overcomes the gas pressure and deflects the diaphragm 50 and the thrust rod 60 in the second direction. The diaphragm 50 and thrust rod 60 continue to move in the second direction as the pressurized gas is released through the exhaust port 120 when the second fingerlike extension 170 engages the toggle element 180. As the thrust rod 60 continues to move in the second direction, the fingerlike extension 170 causes the toggle element 180 to deflect in the second direction. The toggle element 180 continues to deflect in the second direction until the biasing element in the microswitch 130 causes the toggle element 180 to fully deflect in the second direction. Thereafter, the microswitch 130 severs communication between the conduit 110 and the exhaust port 120 and enables communication between the conduit 110 and the inlet port 100. Accordingly, the cycle is repeated.

Figures 3A, 3B, 3C, 3D, 3E:
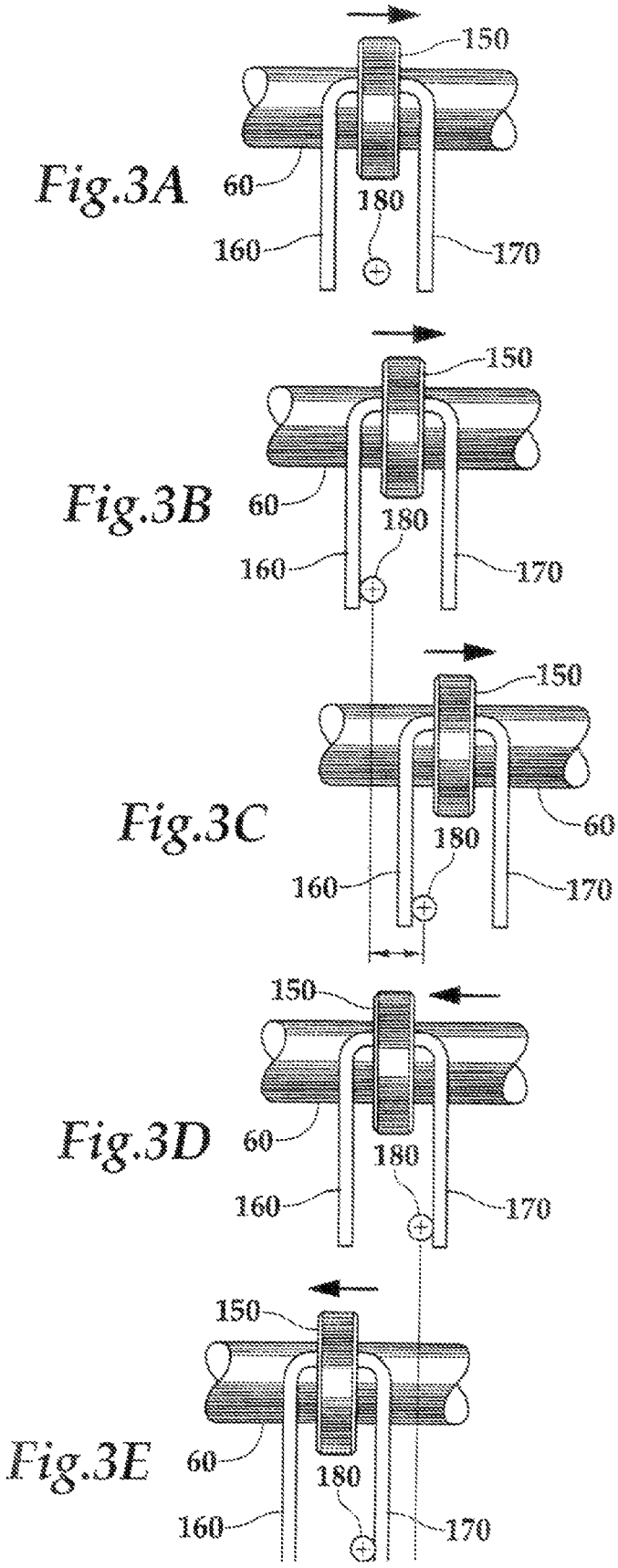
FIGS. 3A-3E illustrate various positions of the collar assembly of FIG. 1 relative to a toggle element of a switching mechanism during a stroke of the pump thrust rod.
Figure 4:
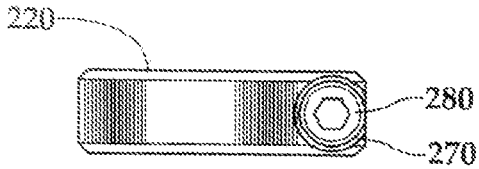
FIGS. 4-10 illustrate various views of the collar assembly according to an embodiment of the present invention.
Figure 5:
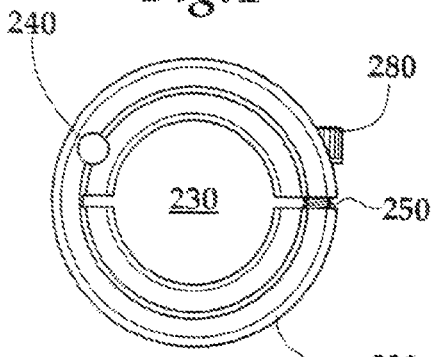
Figure 6:
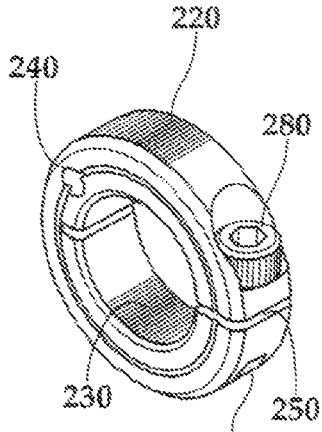
Figure 7:
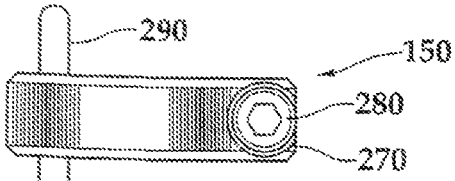
Figure 8:
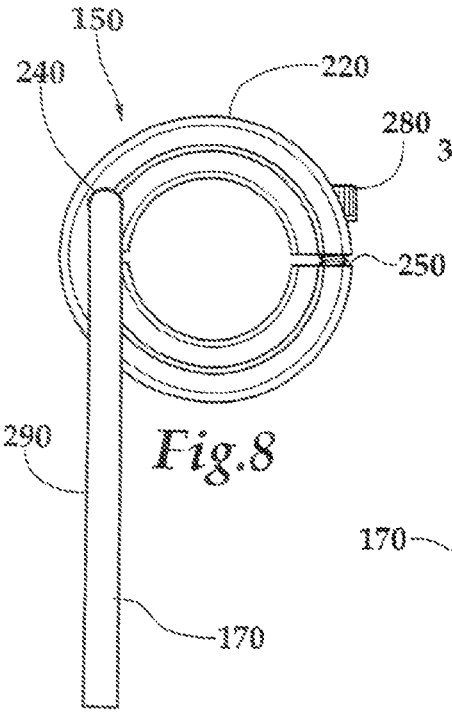

FIGS. 3A-3E are enlarged views of a portion of the chemical injection pump 10, indicating various positions of the collar assembly 150 relative to the toggle element 180 as the pump 10 operates. FIG. 3A illustrates the thrust rod 60 moving in the first direction with the toggle element 180 disposed between the fingerlike extensions 160, 170. In FIG. 3B, the thrust rod 60 has approached the stroke limit in the first direction, and the fingerlike extension 160 has engaged the toggle element 180. FIG. 3C shows that the thrust rod 60 has moved slightly beyond the position shown in FIG. 3B, wherein the fingerlike extension 160 has deflected toggle element 180. As explained above, once toggle element 180 is deflected a certain amount, the biasing element in the microswitch 30 causes the toggle element 180 to fully deflect. Consequently, the microswitch 130 releases the compressed gas from the pump actuator portion 30, and the thrust rod 60 begins moving in the second direction. In FIG. 3D, the thrust rod 60 has approached the stroke limit in the second direction, and the fingerlike extension 170 has engaged the toggle element 180. In FIG. 3E, the thrust rod 60 has moved slightly farther in the second direction, causing the fingerlike extension 170 to displace the toggle element 180. Thereafter, the toggle element 180 fully deflects, causing the microswitch 130 to permit compressed gas to reenter the pump actuator portion 30, and the process repeats.

FIGS. 4-10 illustrate an embodiment of the collar assembly 150 according to the present invention. The collar assembly 150 includes the fingerlike extensions 160, 170 and a circular or ring-shaped collar 220 having a central opening 230 and a second opening 240 offset from the central opening 230. The collar assembly 150 further includes a slit 250 extending through an entire wall thickness of the ring-shaped collar 220 and may extend through a portion of the wall thickness on an opposite side of the collar at 260. The circular collar 220 also includes a bore 270, which intersects the slit 250. According to one embodiment, at least a portion of the bore is threaded and accepts a bolt 280.

According to a further embodiment of the present invention, the fingerlike extensions 160, 170 form a continuous U-shaped member 290 that extends through the second opening 240. The use of a continuous member reduces the number of parts needed to assemble the collar assembly 150, simplifies manufacturing, and, therefore, lowers the manufacturing cost of the collar assembly 150. The continuous U-shaped member 290 includes a central portion 300, which is received into the second opening 240 of collar 220. As shown, the fingerlike extensions 160, 170 are substantially parallel and are substantially perpendicular to the central portion 300. However, the scope of the present invention is not so limited, and the angle defined by each of the fingerlike extensions 160, 170 and the central portion may be any acute or obtuse angle providing for contact of the fingerlike extensions 160 or 170 with toggle 180. Further, the central portion 300 may be enlarged such that the central portion 300 and the second opening 240 engage each other in an interference fit. Consequently, no welding is required to assemble the collar assembly 150. According to one embodiment, the central portion 300 is knurled to form an interference between the U-shaped member 290 and the second opening 240, although the central portion 300 may be enlarged by any method. Further, the U-shaped member 290 may be assembled to the circular collar 220 when the U-shaped member 290 forms a substantially linear element. The U-shaped member 290 is inserted into the second opening until the enlarged central portion 300 engages the second opening 240 to form an interference fit. Thereafter, the outer portions of the continuous member 290 are bent to form the fingerlike extensions 160, 170. As explained above, the fingerlike extensions 160, 170 may form any angle with the central portion 300. According to one embodiment, a distance between the inner-facing surfaces of the fingerlike projections 160, 170 defines a stroke length of the chemical injection pump 10, since the fingerlike extensions 160, 170 trigger the microswitch 130 to inject and exhaust the compressed gas into and out of the pump actuator portion 30.

The collar assembly 150 attaches to the pump 10 by sliding over an outer surface of the thrust rod 60 and is positioned so that the toggle element 180 is located in a space defined between the two fingerlike extensions 160, 170, as shown in FIG. 2. The collar assembly 150 then secures in place by tightening of the bolt 280. The position along the thrust rod 60 may be adjusted so that the fingerlike projections 160, 170 engage the toggle element 180 at a desired position during stroking to ensure that the starting and stopping locations of the stroke are appropriately defined.

Figure 9:
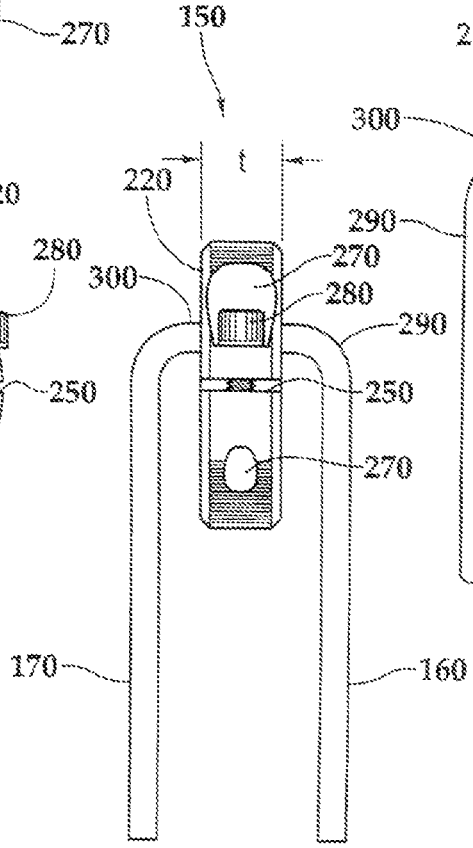
Figure 10:
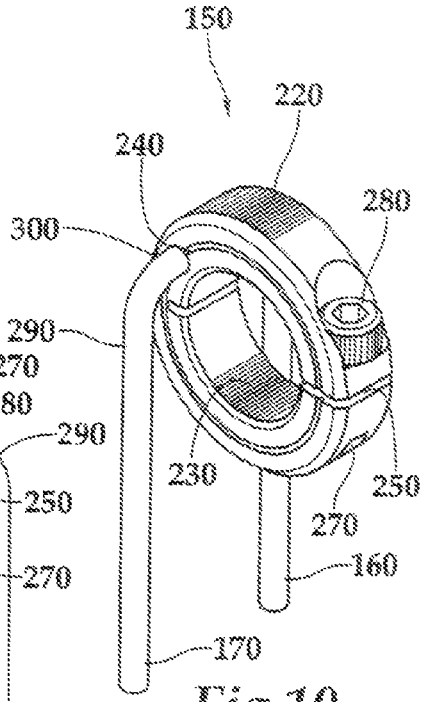

As shown in FIG. 9, the circular collar 220 has a narrow thickness, (t). Consequently, the collar assembly 150 is readily adaptable to different pumps and adjustable thereon without interfering with a portion of the pump 10.

Moreover, the design of the collar assembly 150 is simple and has a reduced number of components compared with pump actuation assemblies presently available, which results in reduced manufacturing costs and simplifies manufacturing.

A number of embodiments of the invention have been described. Nevertheless, it will be understood that various modifications may be made without departing from the spirit and scope of the invention. Accordingly, other embodiments are within the scope of the following claims.

What is claimed is:

1. A method for forming a collar secured to a thrust rod of a chemical injection pump, the method comprising:

forming a ring-shaped member having a central opening;

forming a second opening through the ring-shaped member;

forming a slender member having an central portion;

inserting the slender member through the second opening;

securing the central portion of the slender member to the second opening; and bending opposing ends of the slender member to form a U-shape.

2. The method according to claim 1 further comprising:

forming a slit through a portion of the ring-shaped member;

forming a bore through the ring-shaped member, wherein the bore intersects the slit; and providing a connector for insertion into the bore.

3. The method according to claim 2, wherein the central opening and the second opening have parallel axes.

4. The method according to claim 1, wherein the central portion is secured in the second opening by an interference fit.

5. The method according to claim 4 further comprising:

knurling the central portion of the slender member to enlarge the central portion.

6. The method according to claim 1, wherein the opposing ends are substantially parallel to each other.

7. The method according to claim 1, wherein the opposing ends are substantially perpendicular to the central portion.

8. The method according to claim 1, wherein at least a portion of the bore is threaded to receive the connector.

9. A chemical injection pump comprising:

an actuator;

a thrust rod coupled to the actuator;

a switching mechanism operable to control a pumping action of the pump and including a toggle element;

a collar assembly attached to the thrust rod, the collar assembly including:

a ring-shaped member including a central opening for receiving the thrust rod and a second opening offset from the central opening; and a continuous U-shaped member extending through the second opening, wherein the U-shaped member flanks the toggle element.

10. The chemical injection pump according to claim 9, wherein the U-shaped member comprises a central portion and at least two fingerlike extensions provided at opposing ends of the central portion, and wherein the central portion secures to the second opening of the ring-shaped member.

11. The chemical injection pump according to claim 10, wherein the central portion secures to the second opening with an interference fit.

12. The chemical injection pump according to claim 10, wherein the ring-shaped member further comprises:

a first slit formed through an entire thickness of the ring-shaped member; and a bore for receiving a connector, the bore intersecting the slit.

13. The chemical injection pump according to claim 12, wherein at least a portion of the bore is threaded to receive the connector.

14. The chemical injection pump according to claim 12, wherein the bore forms a through hole, and wherein an axis of the bore is normal to an axis of the central opening.

15. The chemical injection pump according to claim 12, wherein the ring-shaped member further comprises a second slit disposed in a portion of the ring-shaped member adjacent to the central opening and opposite the first slit.

16. The chemical injection pump according to claim 12, wherein the connector comprises a bolt receivable into the bore and operable to fixedly secure the collar assembly to the thrust rod.

17. A retrofit kit for use with a pneumatically operated chemical injection pump having a pneumatic actuator, a thrust rod coupled to the pneumatic actuator, and a switching mechanism having a toggle element, the switching mechanism operable to control a flow of gas to the pneumatic actuator, the kit comprising:

a ring-shaped member including a central opening for receiving the thrust rod and a second opening offset from the central opening;

a continuous U-shaped member extending through the second opening formed in the ring-shaped member, the U-shaped member including at least two a fingerlike extensions adapted to contact opposing sides of the toggle element;

a slit formed through at least an entire wall thickness of the ring-shaped collar; and a bore extending through the ring-shaped collar adapted to receive a connector, the bore intersecting the slit, wherein the connector is operable to fixedly attach the collar assembly to the thrust rod.

18. The retrofit kit according to claim 17, wherein the U-shaped member further comprises a central portion disposed between the fingerlike extensions and wherein the central portion is secured to the second opening by an interference fit.

19. The retrofit kit according to claim 18, wherein the central portion is knurled.

20. The retrofit kit according to claim 17, wherein the fingerlike projections are substantially parallel and wherein the fingerlike projections are substantially perpendicular to the central portion.

21. The retrofit kit according to claim 17, wherein the connector is a bolt adapted to be received in the bore.

* * * * *